US005105058A

United States Patent [19]

Perret

[11] Patent Number: 5,105,058

[45] Date of Patent: Apr. 14, 1992

[54] DIELECTRIC BLAST GAS HIGH VOLTAGE CIRCUIT BREAKER WITH ELECTRICAL RESISTANCE CONDUCTOR

[75] Inventor: Michel Perret, Tramole, France

[73] Assignee: GEC Alsthom SA, Paris, France

[21] Appl. No.: 519,203

[22] Filed: May 4, 1990

[30] Foreign Application Priority Data

May 17, 1989 [FR] France ..... 89 06417

[51] Int. Cl.[5] ..... H01H 31/88

[52] U.S. Cl. ..... 200/148 A; 200/148 R

[58] Field of Search ..... 200/144 AP, 148 R, 148 A

[56] References Cited

U.S. PATENT DOCUMENTS

| | | | |
|---|---|---|---|
| 3,333,077 | 7/1967 | Fish, Jr. | 200/148 |
| 4,069,406 | 1/1978 | Meinders | 200/144 AP |
| 4,577,074 | 3/1986 | Pham | 200/148 A |
| 4,639,565 | 1/1987 | Pham | 200/148 A |
| 4,649,243 | 3/1987 | Thuries | 200/148 A |
| 4,650,941 | 3/1987 | Thuries et al. | 200/148 A |
| 4,650,942 | 3/1987 | Perret | 200/148 A |
| 4,754,109 | 6/1988 | Thuries et al. | 200/148 A |
| 4,774,388 | 9/1988 | Thuries et al. | 200/148 A |
| 4,880,946 | 11/1989 | Thuries et al. | 200/148 A |
| 4,945,197 | 7/1990 | Thuries et al. | 200/148 A |
| 4,945,198 | 7/1990 | Thuries et al. | 200/148 A |

FOREIGN PATENT DOCUMENTS

| | | |
|---|---|---|
| 1514265 | 1/1968 | France . |
| 2503448 | 10/1982 | France . |
| 242103 | 9/1946 | Switzerland . |

*Primary Examiner*—J. R. Scott

*Attorney, Agent, or Firm*—Sughrue, Mion, Zinn, Macpeak & Seas

[57] ABSTRACT

A high or medium tension circuit-breaker having a dielectric gas, the circuit-breaker including stationary and moving main contacts, and a conductor element having high electrical resistance, with the current to be interrupted being constrained to flow through the conductor element once the main contacts have separated.

19 Claims, 5 Drawing Sheets

DIELECTRIC BLAST GAS HIGH VOLTAGE CIRCUIT BREAKER WITH ELECTRICAL RESISTANCE CONDUCTOR

The present invention relates to a high tension circuit-breaker in which a gas having good dielectric properties, such as sulfur hexafluoride ($SF_6$), provides insulation and also serves to blast the arc during a circuit-breaker opening operation. In order to provide the blast, the gas is compressed by a system which is moved relative to a blast cylinder by a circuit-breaker control mechanism.

BACKGROUND OF THE INVENTION

In this type of circuit-breaker, it is common practice to provide means for striking a secondary arc having the effect of heating gas in a determined volume or chamber. The resulting increase in temperature causes the pressure to increase in the volume under consideration and this increase in pressure is used either to produce an auxiliary blast or a second blast on the arc, or to assist in the circuit-breaker opening operation, thereby reducing the power required for controlling the circuit-breaker, or else to provide both of these results simultaneously.

Although this technique presents advantages enabling the above-mentioned objectives to be achieved, it nevertheless suffers from drawbacks. It is always damaging to strike arcs since they necessarily wear away certain parts and these parts must therefore be replaced periodically. In addition, arcs give rise to decomposition products of the insulating gas and these products reduce its dielectric qualities.

An object of the present invention is to provide a circuit-breaker in which a given volume is subjected to heating while the circuit-breaker opens, with the effects of the heating being used to improve the performance of the apparatus, but without requiring a secondary arc to be struck.

SUMMARY OF THE INVENTION

The present invention provides a high or medium tension circuit-breaker having a dielectric gas, the circuit-breaker including stationary and moving main contacts, and a conductor element having high electrical resistance, with the current to be interrupted being constrained to flow through said conductor element once the main contacts have separated.

BRIEF DESCRIPTION OF THE DRAWINGS

Embodiments of the invention are described by way of example with reference to the accompanying drawings, in which.

DETAILED DESCRIPTION

Figure 1:
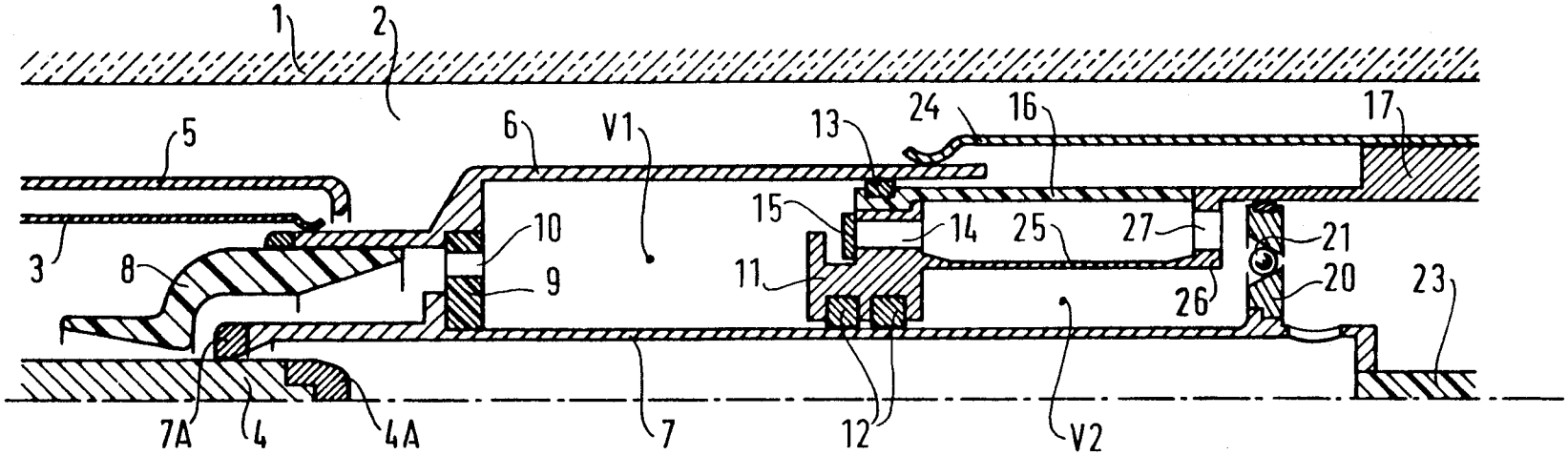
FIG. 1 is a diagrammatic axial half-section through a first embodiment of a circuit-breaker of the invention shown in the closed position.

In FIG. 1, reference 1 designates a cylindrical insulating casing about an axis xx delimiting a volume 2 filled with a gas having good dielectric properties, such as sulfur hexafluoride ($SF_6$). The circuit-breaker current interrupting chamber including both stationary elements and moving equipment is to be found inside this casing. The stationary elements include fingers 3 disposed in a tulip configuration and constituting the stationary permanent contact, and a tube 4 about the axis xx and terminated by an end 4A made of material which withstands the effects of arcing and constituting the stationary arcing contact. The stationary permanent contact is connected to a first current terminal (not shown). Reference 5 designates an anti-corona cap surrounding the stationary permanent contact.

The moving equipment comprises a first metal tubular part 6 which is substantially tubular in shape and which constitutes the moving permanent contact, and a second metal tubular part 7 terminated by a wear part 7A and constituting the moving arcing contact. The parts 6 and 7 are coaxial about the axis xx. The part 6 carries a nozzle 8 made of an insulating material such as polytetrafluoroethylene. The parts 6 and 7 are interconnected by an insulating annular part or ring 9 pierced by holes 10. The parts 6 and 7 delimit an annular blast chamber or volume V1 which is closed at its end furthest from the ring 9 by means of a stationary metal piston 11. This piston includes sliding electrical contacts 12 which co-operate with the tube 7, a dynamic sealing ring 13 in contact with the tube 6, and orifices 14 capable of being closed by an annular non-return valve 15. The piston is held in place by a tube 16 made of insulating material which is itself fixed to a stationary metal part 17 connected to a second current terminal (not shown). The tubes 7 and 16, and the piston 11 define a second chamber or volume V2 which is closed by an annular part 20 made of insulating material and fixed to the two above-mentioned tubes. The part 20 is provided with an orifice closed by a non-return check valve 21 which allows gas to pass only from the outside towards the inside of the volume V2. The tube 7 is connected to a drive rod 23 made of insulating material.

The part 17 and the tube 6 are electrically interconnected by fingers 24 fixed at one end to the part 17 and rubbing at their opposite ends over the tube 6. The part 17 and the piston 11 are electrically interconnected by a metal element 25 having high electrical resistance. In the example shown in FIG. 1, this element is constituted by a tube of nickel chrome steel which is welded to a rim 26 on the part 17 which rim is pierced by openings 27. In a variant, the element is constituted by a plurality of resistance rods or wires, and the material from which the element is made may, more generally, be constituted by any material capable of imparting sufficient resistance to the element to enable it to be heated to a temperature close to 1000° C. and enabling it to withstand such heating. Particular mention may be of tungsten and its alloys, and of metallic oxides and of non-metallic oxides.

The circuit-breaker operates as follows:

Under normal circumstances current flows through the fingers 3, the tube 6, the fingers 23, and the part 17.

Figure 2:
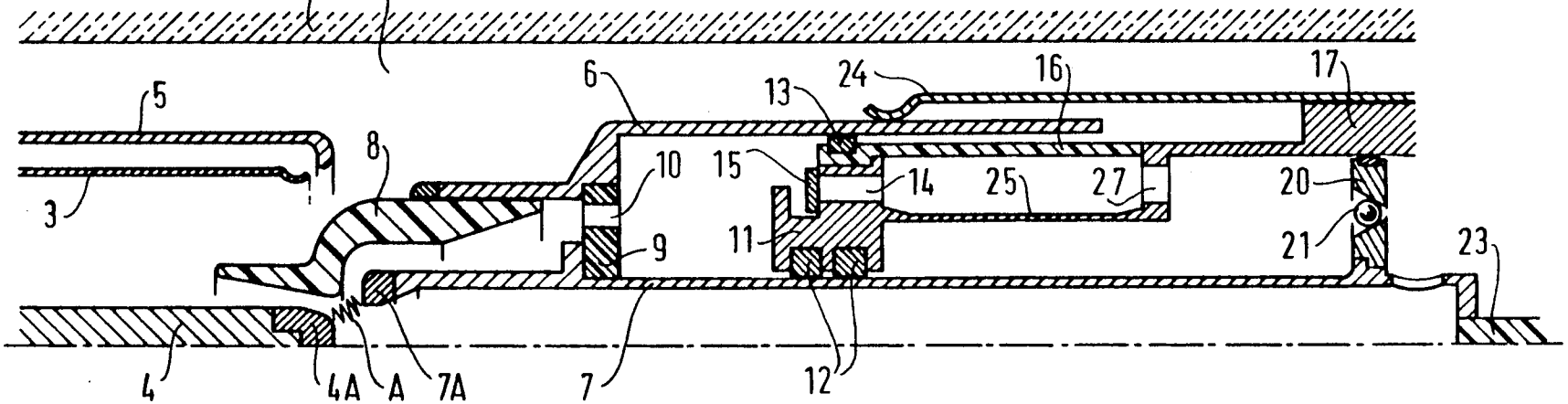
FIG. 2 is a view of the same circuit-breaker during an opening operation.

When the circuit-breaker is opened, the drive rod is actuated and moves to the right in FIG. 1. When the main contacts 3, 6 separate, current passes via the tube 4, the tube 7, the contacts 12, the piston 11, the resistive element 25, and the part 17. When the arcing contacts 4 and 7 separate, an arc A is stuck between them (FIG. 2). If the circuit-breaker is opened on a fault, the magnitude of the current flowing through the circuit-breaker is very high. This results in the part 25 heating up very considerably, thereby greatly increasing the temperature of the surrounding gas and consequently greatly increasing the pressure in the volume or chamber V2. This pressure is exerted on the part 20 whose non-return valve 21 is closed, and assists in driving the circuit-breaker moving contacts under opening operation.

The circuit-breaker of the invention offers several advantages over circuit-breakers using a secondary arc:

The mass of the moving equipment is lighter than in secondary arc circuit-breakers, thereby reducing the energy required for performing the operation and thus reducing the cost of the drive mechanisms.

Unlike an arc, the heating of the resistive element does not pollute the insulating gas of the circuit-breaker, and as a result the circuit-breaker conserves its dielectric qualities for a longer period of time, thereby making it possible, inter alia, to reduce the frequency with which molecular sieves are replaced.

None of the parts of the circuit-breaker is left at a floating potential as happens in secondary arc circuit-breakers, thereby requiring additional contacts to be provided, which increase the cost of the apparatus.

Figure 3:
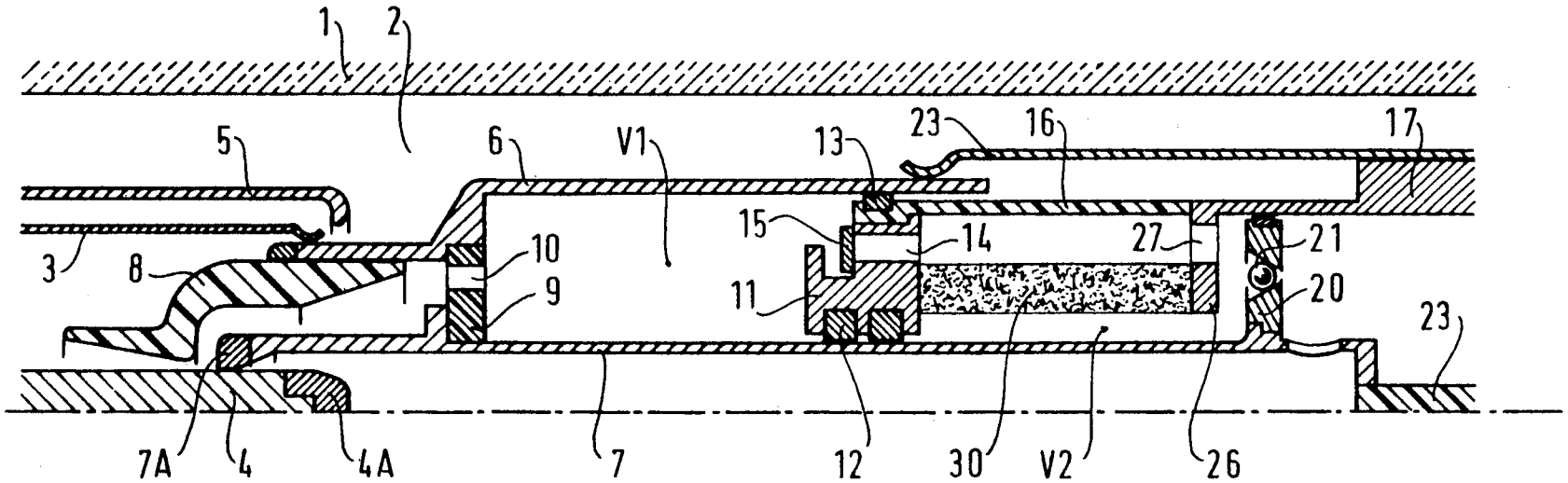
FIG. 3 is a diagrammatic view of a second embodiment of the invention shown in the closed position.

In the variant embodiment shown in FIG. 3, items that are common to FIG. 3 and to FIG. 1 are given the same reference numerals. In this case, the resistive element is a metal, tubular sponge 30 made of wires having a high degree of resistivity, in the form of wire wool, or else by means of a porous material (sintered oxide or metal) having a large void factor. An element made in this way has a large heat exchange area with the surrounding gas, thereby facilitating heating of the gas.

Figure 4:
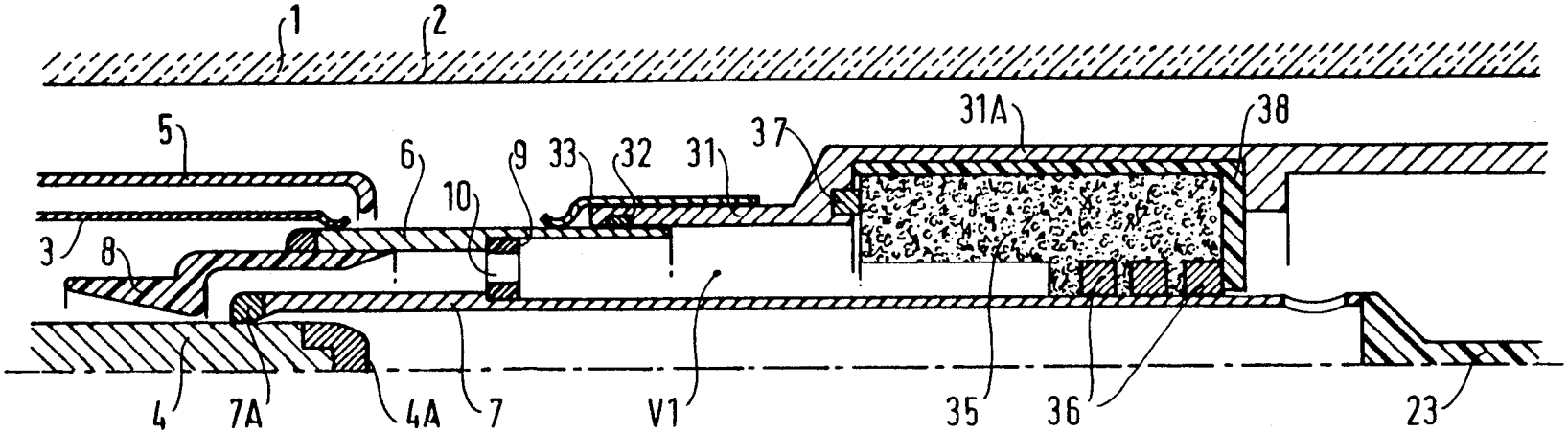
FIG. 4 is a diagrammatical axial half-section through a third embodiment of a circuit-breaker of the invention, shown in the closed position.
Figure 5:
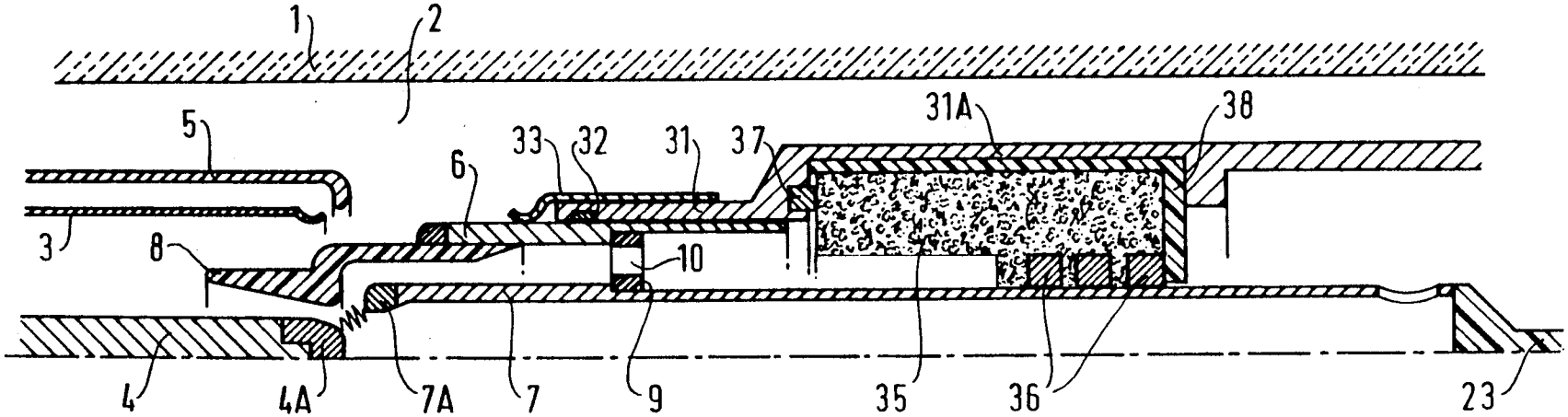
FIG. 5 is a view of the same circuit-breaker shown during an opening operation.

In the variant embodiment shown in FIGS. 4 and 5, items that are common to these figures and to FIG. 1 have been given the same reference numerals. There are the same stationary contacts 3 and 4 and the cap 5, the same arcing contacts 6 and 7 interconnected by the part or ring 9, 10, the drive rod 23, and the blast nozzle at the end of the blast volume or chamber V1. The moving permanent contact 6 slides inside a fixed tube 31 provided with a dynamic seal 32 and with electrical contact fingers 33. The tube 31 which is connected to the second terminal of the circuit-breaker has a portion 31A of larger diameter enabling it to contain a sponge 35 of high electrical resistance. As before, the sponge is made either in the form of wire wool or else in the form of a porous volume or mass. The sponge is provided with sliding electrical contacts 36 engaging the arcing contact 7 and with the stationary electric contacts 37 providing a metallic connection between the sponge 35 and the tube 1. An insulating sleeve 38 disposed between the tube 31 and the sponge 35 constrains current from the contacts 36 to flow through the entire volume of the sponge before reaching the contacts 37. The circuit-breaker operates as follows:

Under steady conditions, FIG. 4, current flows through the fingers 3, the tube 6, the fingers 3, and the tube 31A.

When the main contacts separate, current passes through the arcing contacts 4 and 7, the contacts 36, the resistive sponge 35, the contacts 37, and the tube 31A.

When the arcing contacts separate, FIG. 5, an arc A is struck between them and current then flows via the contact 4, the arc A, the tube 7, the contacts 36, the sponge 35, the contacts 37, and the tube 31A.

When interrupting low currents (e.g. the nominal current), the heating of the sponge is negligible and the current is interrupted by a blast due solely to the mechanical compression in the reduced volume or chamber V1, with the metal sponge acting solely as a piston.

When interrupting high currents (e.g. short circuit currents), the sponge heats up vigorously and heats the gas contained therein, thereby raising the pressure of the gas which escapes from the sponge. The mechanical blast action thus has assistance from the volume of gas expelled from the sponge by thermal action.

The circuit-breaker shown in FIGS. 4 and 5 has a very lightweight moving portion since, compared with the embodiments of the preceding figures, it is possible to reduce the blast volume and thus the diameter of the cylinder 6, and consequently to reduce its mass.

Figure 6:
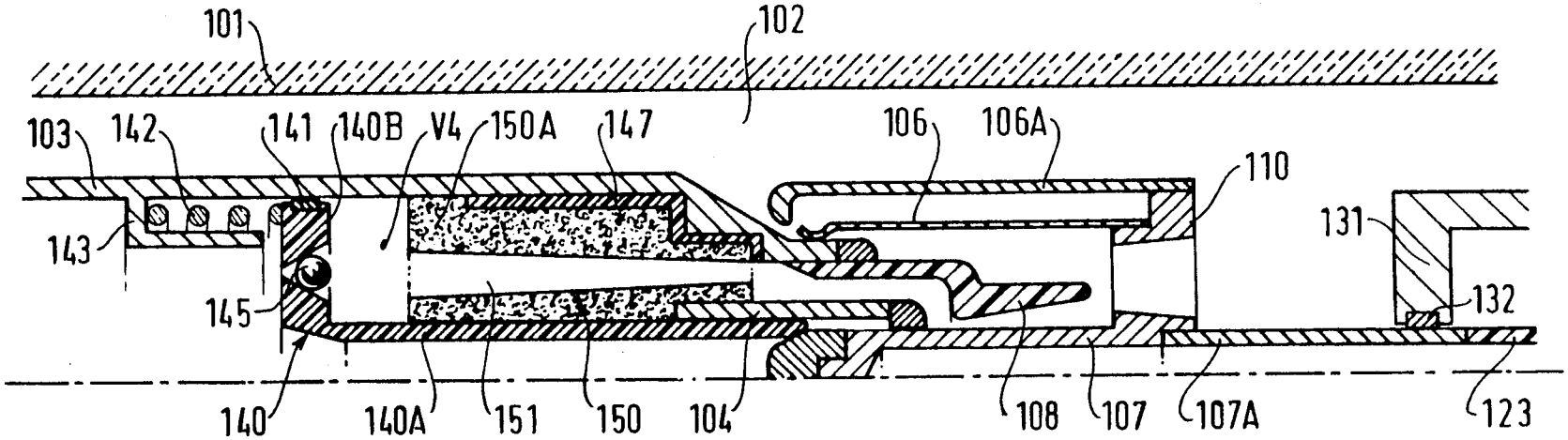
FIG. 6 is a diagrammatic axial half-section through a fourth embodiment of a circuit-breaker of the invention shown in the closed position.
Figure 7:
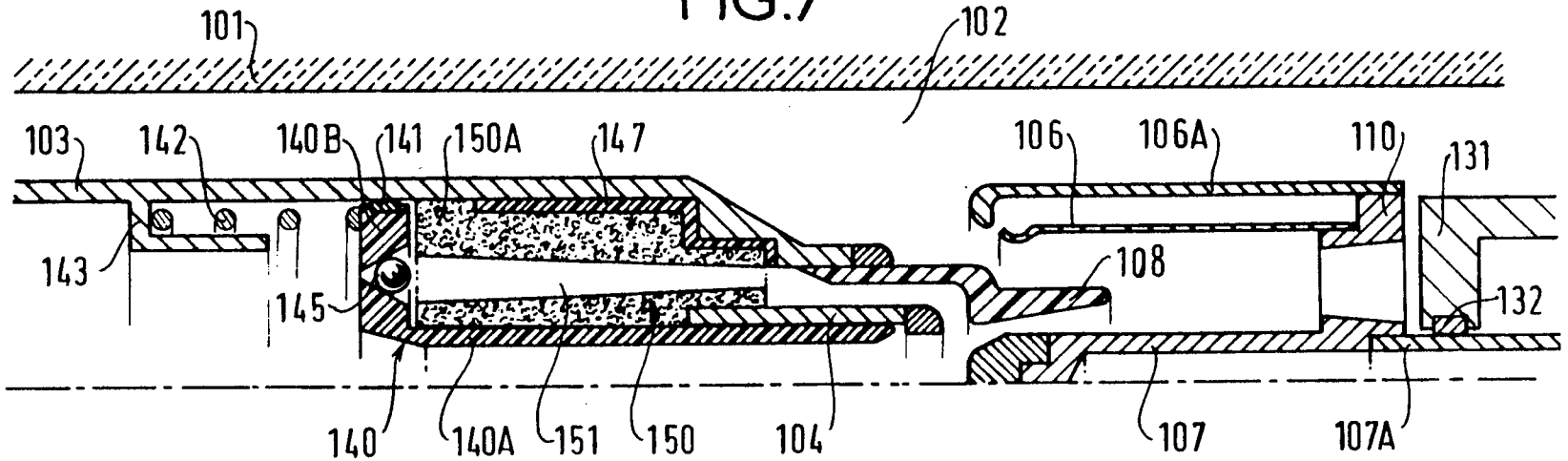
FIG. 7 is a view of the same circuit-breaker during an opening operation for the purpose of interrupting a low current.
Figure 8:
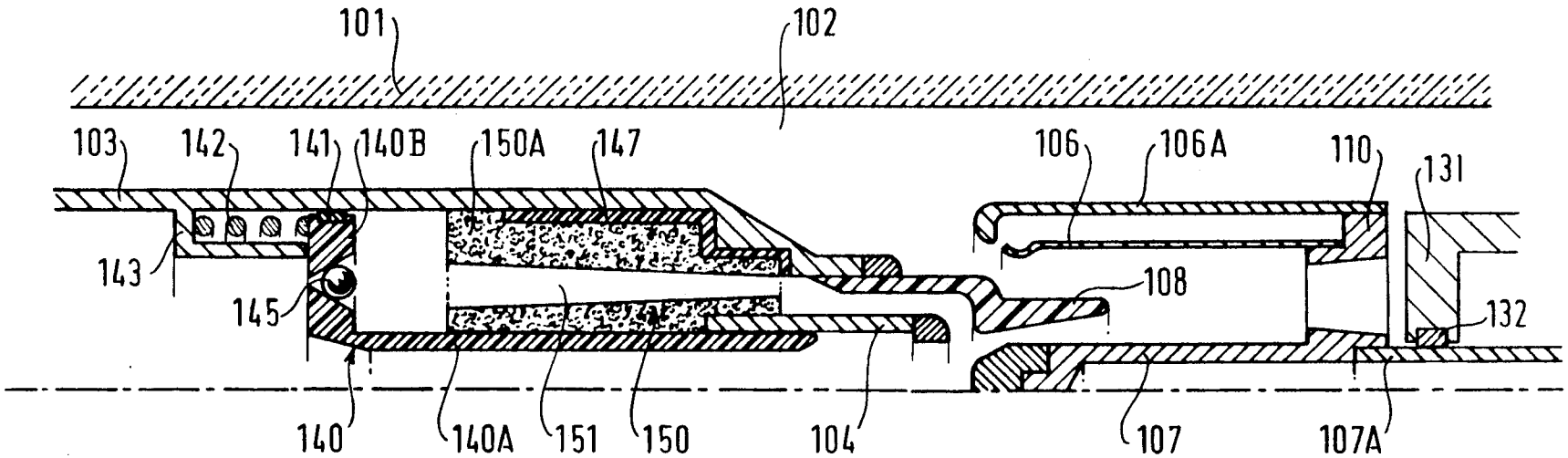
FIG. 8 is a view of the same circuit-breaker during an opening operation for the purpose of interrupting a high current.

FIGS. 6 to 8 show an embodiment in which the blast nozzle 103 is fixed to the stationary portion of the circuit-breaker instead of being fixed to the moving portion as shown in the embodiments of FIGS. 1 to 5. In FIG. 6, there is a cylindrical ceramic casing 101 about the axis xx, the casing being filled with insulating gas and having circuit-breaking members disposed therein. The stationary elements include a substantially tubular part 103 about the axis xx serving as a stationary permanent contact and connected to a first current terminal (not shown), a tube 104 coaxial with the tube 103 and mechanically and electrically connected to the tube 103 and constituting a stationary arcing contact. A blast nozzle 108 of insulating material is fixed to the tube 103. The moving equipment includes contact fingers 106 constituting a moving contact, and fixed to a ring 110 machined in a tube 107 constituting the moving arcing contact. The tube 107 is extended by a metal tube 107A electrically connected to a second current terminal 131 by sliding contacts 132. The tube 107A is mechanically connected to a drive rod 123 made of insulating material.

A part 140 made of insulating material has a cylindrical portion 140A constituting a cylinder and an annular portion 140B constituting a piston and is disposed coaxially inside the tube 103. Sealing between the piston 140B and the tube 103 is obtained by a dynamic seal 141. The part 140 is capable of moving inside the tube 103 under drive from a spring 142 in abutment against a part 143 fixed to the tube 103. The piston 140B includes openings 144 which are closed by a non-return, check valve 145.

A metal sponge 150 of the type described above is disposed inside the part 140. The sponge has a portion 150A situated at a distance from the arcing contact 104 and in electrical contact with the tube 103. A sheath of insulating material 147 partially insulates the sponge 150 from the tube 103 so as to impart a path of maximum length to current flowing through the sponge. The sponge does not occupy all of the volume inside the part 103 when the circuit-breaker is in the closed position (FIG. 6). On the contrary, it leaves a volume or chamber V4 in communication with the blast nozzle via channels 151 made through the sponge.

The circuit-breaker operates as follows:

When the circuit-breaker is in the closed position (FIG. 6), the spring 142 stores energy and the volume or chamber V4 is at a maximum. Current flows through the tube 103, the fingers 106, the ring 110, the tube 107A, the contacts 132, and the terminal 131.

Interrupting low currents, are currents close to the nominal value.

Reference is made to FIG. 7. The moving equipment is displaced to the right of the figure. When the arcing contacts 104 and 107 separate, the arc is struck therebetween. The arc is easily interrupted by the gas from the volume or chamber V4 which is compressed by the displacement of the piston 140B driven by the spring 142 relaxing.

Interrupting high currents are short-circuit currents.

Reference is made to FIG. 8. When the arcing contacts separate, current flows through the tube 103, the resistive sponge 150, the arcing contact 104, the arc itself, the tube 107, the tube 107A, the contact 132, and the terminal 131. On flowing through the sponge, the very high current heats up the sponge and expels the gas contained therein. The increase in pressure has two effects: firstly it prevents the piston 140B moving in spite of drive from the spring; secondly it provides energetic blasting of the arc via the nozzle 108. This blasting due to purely thermal action is followed by subsequent mechanical action produced by the spring relaxing.

The invention is applicable to high tension circuit-breakers (greater than 45 kV) and to medium tension circuit-breakers (lying in the range 2 kV to 45 kV).

The invention is not limited in any way to the embodiments described and shown above since it is quite general in application.

I claim:

1. A high voltage circuit breaker comprising an insulating housing (1) filled with a dielectric gas under pressure, said housing including stationary tubular main (3) and arcing (4) contacts connectable to a current source, and a mobile assembly including tubular moving main (6) and arcing (7) contacts, said moving main and arcing contacts defining with a stationary piston (11) fixed to a stationary tubular insulating member (16), a puffing chamber (VI) terminated by a blast nozzle (8), said moving main contact (6) being in electrical sliding contact with a stationary metal (23, 17) part and being electrically connectable to said current source, a conductor element (25) having high electrical resistance being slidably electrically connected to said moving arcing contact (7), and electrically connected to said stationary metal part (17), said conductor element (25) defining with said piston (110), said moving arcing contact (7), said stationary tubular insulating member (16) and an annular piece (20) fixed to said moving arcing contact (7) a second chamber (V2), said conductor element (25) being thus series connected between said moving arcing contact (7) and said stationary metal part (17), whereby, with electrical current supplied to said main and arcing contacts, when the arcing contacts (4, 7) separate, a current path is created through the arcing contact 4, 7, the stationary piston 11, the conductor element 25, and the stationary metal part 17 heating the gas in the second chamber (V2) such that by temperature increase of gas in said second chamber, and the pressure increase thereof as temperature of the gas increases, exerts a force on the annular part 20 to accelerate the opening of the arcing contacts of the circuit breaker.

2. A circuit-breaker according to claim 1, wherein the said conductor element is in the form of a tube.

3. A circuit-breaker according to claim 1, wherein the said conductor element is in the form of a plurality of rods.

4. A circuit-breaker according to claim 1, wherein the said conductor element is in the form of a plurality of wires.

5. A circuit-breaker according to claim 4, wherein the said wires are made of a material selected from the group consisting of: nickel chromium steel; tungsten, alloys of tungsten and; metallic oxides.

6. A circuit-breaker according to claim 1, wherein the said conductor element is in the form of wire wool.

7. A circuit-breaker according to claim 1, wherein the said conductor element is in the form of a porous mass.

8. A circuit-breaker according to claim 7, wherein the material of said element is a sintered oxide.

9. A high-voltage circuit breaker comprising: an insulating housing (1) filled with a dielectric gas under pressure, said housing including stationary tubular main (3) and arcing (4) contacts, and a mobile assembly including tubular main (31) and arcing (7) contact, said moving main and arcing contacts defining a puffing chamber (V1) terminated by a blast nozzle, juxtposed to said stationary and mobile arcing contacts, said moving arcing and main contacts being electrically connected through a high electric resistance conductor element (35) within said puffing chamber by means of at least one sliding contact (36) engaging said moving arcing contact (7) whereby, with electrical current supplied through said main and arcing contacts, when the arcing contacts (4, 7) separate, current passing through said high electric resistance conductor element, heats a gas, within said puffing chamber thereby raising the pressure of the gas to assist in expelling gas from the puffing chamber through said blast nozzle.

10. The high voltage circuit breaker as claimed in claim 9, wherein said high electrical resistance conductor element comprises a metallic sponge.

11. A high voltage circuit breaker according to claim 9, wherein said high electrical resistance conductor element is made of a material selected from the group consisting of nickel chromium steel, tungsten, alloys of tungsten, and metallic oxides.

12. A high voltage circuit breaker according as claimed in claim 9, wherein said high electrical resistance conductor element is the form of a porous mass.

13. A high voltage circuit breaker according as claimed in claim 12, wherein the material of the high electrical resistance conductor element is a sintered oxide.

14. A high voltage circuit breaker comprising: a housing (101) filled with a dielectric gas under pressure, said housing including stationary tubular main (103) and arcing (104) contacts and moving tubular main (106) and arcing (107) contacts, said stationary tubular main and arcing contacts (103, 106) defining with a semi-mobile piston (140B), a puffing chamber (V4) terminated by a blast nozzle, a high electrical resistance element partially filling said puffing chamber, means for partially insulating said high electrical resistance conductor element such that when an electric current is applied across said stationary tubular main (103) and arcing (104) contacts and respectively tubular moving main (106) and arcing (107) contacts, the electrical current crosses said high electrical resistance conductor element from the stationary main contact (103) to the tubular stationary arcing contact (104), when the stationary and moving arcing contacts (106, 107) separate, thereby heating gas in the vicinity of the high electrical resistor element and rapidly expelling the heated gas with the puffing chamber through said blast nozzle.

15. The high voltage circuit-breaker as claimed in claim 14, wherein said semi-mobile piston (140B) is slidably and sealably positioned co-axially inside of the tubular stationary main contact (103) and, said high voltage circuit breaker further includes a coil spring interposed between the tubular stationary main contact (103) and said semi-mobile piston (140B) and biasing said semi-mobile piston (140B) in the direction of said blast nozzle (108), said semi-mobile piston (140B) includes a non-return check valve permitting gas to enter the puffing chamber (V4) but preventing escape therefrom, such that when said arcing contacts (104, 107) separate, the increase in pressure as a result of heating of said high electrical resistance conductor element and passage of current therethrough, momentarily prevents the mobile piston (140B) from moving in a direction tending to expel a gas from the puffing chamber in the direction of the blast nozzle permitting initially, blasting by thermal action due to heating and pressure increase in the gas within said puffing chamber and then, by subsequent mechanical action movement of the semi-mobile piston (140B) in the direction of the blast nozzle as a result of expansion of the coil spring.

16. The high voltage circuit breaker as claimed in claim 14, wherein said high electrical resistance conductor element comprises a metallic sponge.

17. A high voltage circuit breaker according to claim 14, wherein said high electrical resistance conductor element is made of a material selected from the group consisting of nickel chromium steel, tungsten, alloys of tungsten, and metallic oxides.

18. A high voltage circuit breaker according as claimed in claim 14, wherein said high electrical resistance conductor element is the form of a porous mass.

19. A high voltage circuit breaker according as claimed in claim 14, wherein the material of the high resistance conductor element is a sintered oxide.

* * * * *